US007717053B2

(12) United States Patent
Jayne

(10) Patent No.: US 7,717,053 B2
(45) Date of Patent: May 18, 2010

(54) SPRING LINE ASSEMBLY

(76) Inventor: William Jayne, 21 Tuthill Point Rd., East Moriches, NY (US) 11940

( * ) Notice: Subject to any disclaimer, the term of this patent is extended or adjusted under 35 U.S.C. 154(b) by 369 days.

(21) Appl. No.: 11/767,090

(22) Filed: Jun. 22, 2007

(65) Prior Publication Data

US 2008/0314304 A1 Dec. 25, 2008

(51) Int. Cl.
*E02B 3/24* (2006.01)
*B63B 21/00* (2006.01)

(52) U.S. Cl. ..... 114/230.18; 114/230.1; 114/230.15; 114/230.17

(58) Field of Classification Search ..... 114/230.1, 114/230.15, 230.16, 230.17, 230.18, 230.19, 114/230.2, 230.21, 230.22, 230.24, 230.25, 114/230.27, 230.28, 230.29, 230.3
See application file for complete search history.

(56) References Cited

U.S. PATENT DOCUMENTS

| | | | | |
|---|---|---|---|---|
| 1,615,568 | A | | 1/1927 | Carroll |
| 2,129,338 | A | | 9/1938 | Timmons |
| 2,593,940 | A | | 4/1952 | Van Meter |
| 3,129,688 | A | | 4/1964 | Buchholz |
| 3,224,404 | A | | 12/1965 | De Jong |
| 3,788,258 | A | | 1/1974 | Odom |
| 3,861,346 | A | | 1/1975 | Pina |
| 3,993,013 | A | | 11/1976 | Nunziato et al. |
| 4,519,643 | A | | 5/1985 | Harris |
| 4,627,375 | A | | 12/1986 | Davis et al. |
| 4,817,551 | A | | 4/1989 | Matson |
| 4,955,309 | A | | 9/1990 | Ciccone |
| 5,046,442 | A | * | 9/1991 | Hay ..... 114/230.17 |
| 5,307,753 | A | | 5/1994 | Besonen, Sr. et al. |
| 5,398,634 | A | | 3/1995 | Eagan |
| 5,524,566 | A | | 6/1996 | Rapa et al. |
| 5,586,514 | A | | 12/1996 | Yuscavage |
| 5,634,421 | A | | 6/1997 | Velarde |
| 5,694,879 | A | | 12/1997 | Taylor |
| 5,832,861 | A | | 11/1998 | Taylor |
| 5,970,697 | A | * | 10/1999 | Jacobs et al. ..... 57/22 |
| 6,053,129 | A | | 4/2000 | Akre |
| 6,273,017 | B1 | | 8/2001 | Griffin |
| 6,345,583 | B1 | * | 2/2002 | Thackston et al. ..... 114/213 |
| 6,390,009 | B2 | | 5/2002 | Brown et al. |
| 6,443,086 | B1 | | 9/2002 | Actis-Grande et al. |
| 2004/0237867 | A1 | | 12/2004 | Dunn |
| 2005/0061223 | A1 | | 3/2005 | Carr |

* cited by examiner

*Primary Examiner*—Daniel V Venne
(74) *Attorney, Agent, or Firm*—Price, Heneveld, Cooper, DeWitt & Litton, LLP

(57) ABSTRACT

A mooring device including two telescoping tubes, a pair of ropes for securing a boat to a dock or piling, and a spring biasing the ropes and/or tubes with respect to one another to adjust to changes in waves and/or tides, while maintaining the boat at a safe distance from the dock or piling.

12 Claims, 2 Drawing Sheets

SPRING LINE ASSEMBLY

BACKGROUND OF THE INVENTION

The present invention relates to mooring devices for securing a boat to a piling, cleat, or other element of a dock, and more particular, to a spring line assembly, which is easy and convenient to handle and enables a boater to quickly moor and secure a boat.

Operators of boats are often faced with the task of safely and easily bringing boats to a stop adjacent to a dock and then trying to moor the boat with suitable docking lines or ropes. In the past, a boater had to often cast or throw a loose line to a person on the dock or attempt to throw a loop formed at the end of the line around the post or piling in order to secure the boat to the dock. As an alternative, boaters can use boat hooks to grapple for a post, while at the same time, attempt to keep the boat from smashing against the post. These prior methods are unreliable and often result in damage to the operator's boat or other boats that may be docked nearby.

Additionally, when the boat is moored to a dock and/or piling, via a rope around one of the boat's cleats attached to the dock, the rope generally has limited stretching capabilities. Thus, if the boat rocks and moves away from the dock, then the rope may become taut and pressure may be then put on the hull of the boat, especially at the location of the tied cleat. This may cause undesirable stress and fractures in the hull. Additionally, if the boat is secured too tightly, the boat will have greater and more frequent impacts with the dock. If the boat is secured too loosely to the dock, it is able to gain momentum before collision with the dock, allowing damage to the boat and/or dock. Wakes created by passing boats, persons moving about on the boat, or waves, will generally cause the boat to impact the docking object and/or place stress on the rope.

Marine bumpers may be used to cushion the boat from impact with the dock and/or pilings. These bumpers are generally placed between the boat and the docking object to dampen the impact between the two objects. However, there may still remain some stress applied to the boat cleats or some damage due to the impact of the boat, despite the use of marine bumpers.

To further explain the force that a boat receives while docked, a great deal can be explained by examining the mooring line used to moor a boat. It is very well known that the wake from a passing vessel or waves causes the mooring lines of the boat to first relax, gather some slack, and then, as the wave ebbs, the lines become taut, imparting a shock in the line, which is transmitted to the boat itself. The shocks applied are disruptive, as well as having deleterious effects on the mooring lines, boat, and dock. Repeated applications of impact loads gradually stretch and weaken the mooring lines, and can damage the boat and docking objects.

Therefore, there is a current need for an apparatus that is easy to use and has shock-absorbing qualities to help facilitate the safe mooring of a boat to a dock.

SUMMARY OF THE INVENTION

One aspect of the present invention relates to a mooring device that includes a first tube and a second tube telescopingly received within the first tube and extendable between a retracted and an extended position. A spring member operably couples the first tube and the second tube and biases the second tube towards the retracted position. A rope is attached to the first end of the first tube and a second rope is attached to the spring member, both ropes being used to moor a boat to an associated dock and/or piling.

Another aspect of the present invention relates to a mooring device that includes a first tube and a second tube telescopingly received within the first tube with a longitudinally extending hollow interior space within the second tube. A first rope is attached to the first tube and operably coupled to a coil spring. A second rope is operably coupled to the coil spring, such that the coiled spring biases the second rope towards the first rope, while the second rope extends through the interior space of the second tube. The ropes are used to moor the boat and the spring coil allows the device to compensate for changes in waves while maintaining the moored boat at a safe distance from the dock.

The present inventive mooring device provides an inexpensive device that allows for easy docking of a boat and maintains the boat at a safe distance from the dock, despite changes in waves. The assembly is easy to utilize, by even an unskilled person, is economical to manufacture, capable of a long operating life, and is particularly well adapted for the proposed use.

These and other features, advantages, and objects of the present invention will be further understood and appreciated by those skilled in the art by reference to the following specification, claims and appended drawings.

DETAILED DESCRIPTION OF THE PREFERRED EMBODIMENTS

For purposes of description herein, the terms "upper," "lower," "right," "left," "rear," "front," "vertical," "horizontal," and derivatives thereof shall relate to the invention as oriented in the figures. However, it is to be understood that the invention may assume various alternative orientations and step sequences, except where expressly specified to the contrary. It is also to be understood that the specific devices and processes illustrated in the attached drawings and described in the following specification are exemplary embodiments of the inventive concepts defined in the appended claims. Hence, relative dimensions and other physical characteristics relating to the embodiments disclosed herein are not to be considered as limiting, unless the claims expressly state otherwise.

Figure 1:
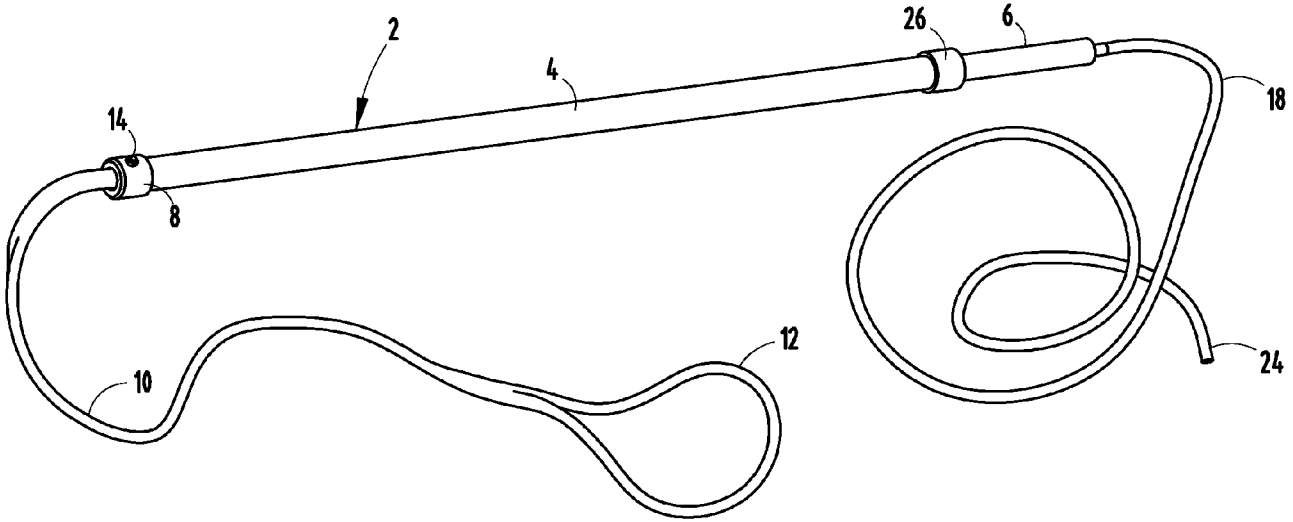
FIG. 1 is a perspective view of a spring line assembly.
Figure 2:
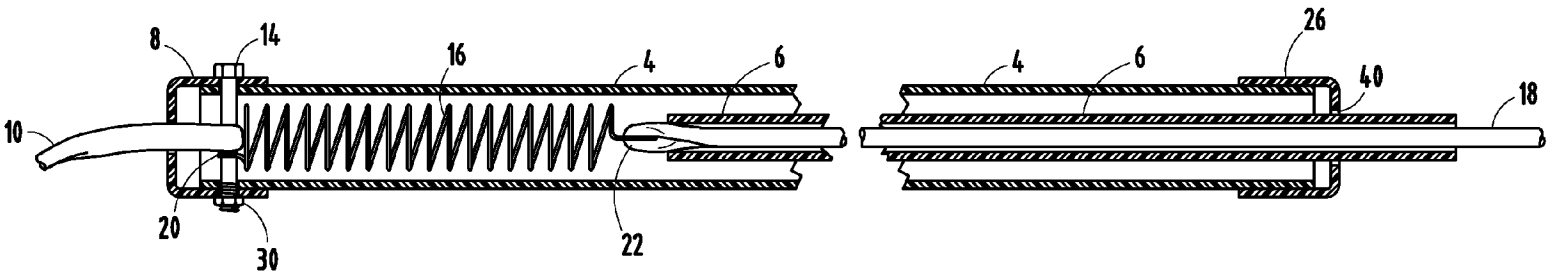
FIG. 2 is a longitudinal and cross-sectional view of the spring line assembly embodying the present invention.
Figure 3:
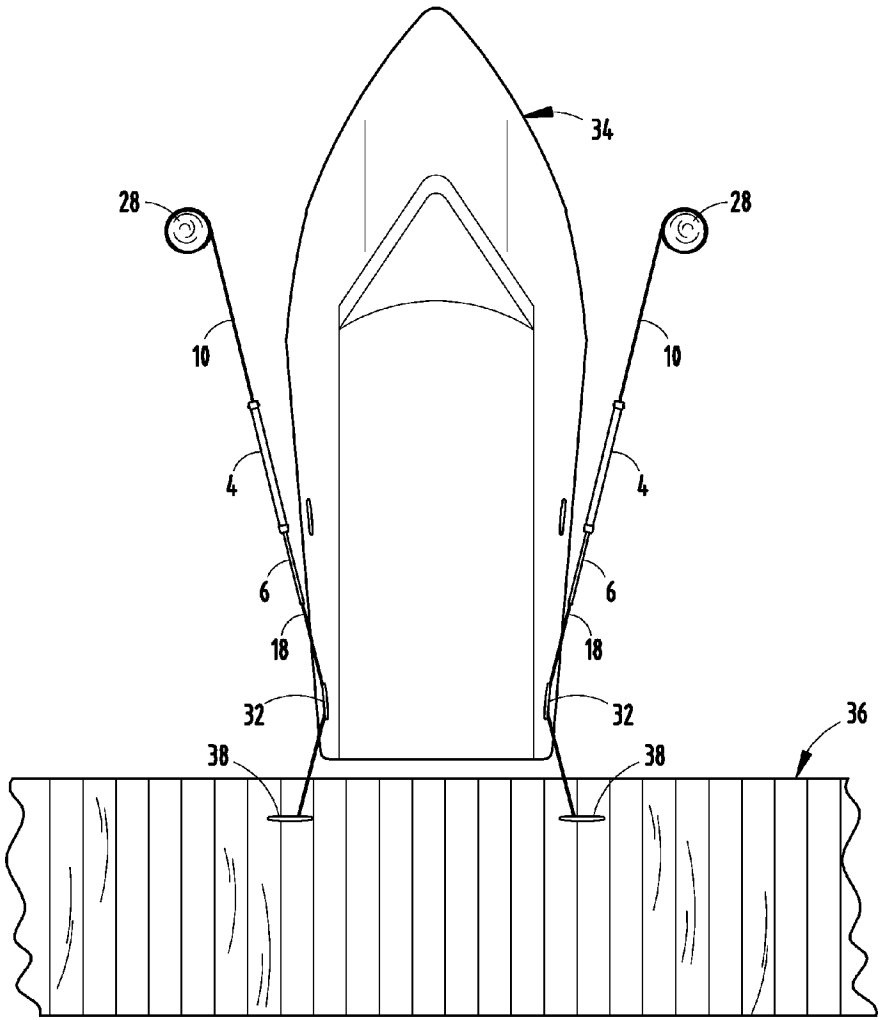
FIG. 3 is a fragmentary top perspective view illustrating a boat that has been moored to a dock using the spring line assembly.

Reference numeral 2 generally designates a spring line assembly embodying the present invention. In the illustrated example, the spring line assembly 2 comprises a first rope 10 with a spliced loop 12 at one end to loop around a piling 28 (FIGS. 1-3). The first rope 10 passes through a hole drilled in a 1-inch end cap 8 of the device and is spliced around a 5/16-inch bolt 14. The bolt 14 passes through one side of the end cap 8, through a larger telescoping tube 4, through a loop 20 on one end of a spring 16, through the other side of the larger telescoping tube 4, and lastly, through the other side of the end cap 8, and is held in place with a 5/16-inch lock nut 30 on the threaded end of the bolt 14. Thus, the spring loop 20, the portion of the bolt 14 through which the loop 20 passes and the portion of the first rope 10 that is placed around the cleat or piling are concealed within the inside of the larger telescoping tube 4. For the illustrated embodiment, the larger telescoping tube is a 1-inch PVC pipe.

While the spring 16 is held in position by the 5/16-inch bolt 14, the opposite end of the spring 16 has a loop 22, which is attached to a second rope 18. The second rope 18 is spliced to that spring loop 22 and passes through the center of a smaller telescoping tube 6. In the illustrated embodiment, the smaller telescoping tube 6 is a ½-inch PVC pipe and is approximately 48 inches in length. The smaller telescoping tube 6 passes through a ⅝-inch hole drilled into the 1-inch end cap 26 of the other end of the larger telescoping tube 4. The smaller telescoping tube 6 acts as a protective sleeve to prevent the second rope 18 from chafing as it slides in and through the end cap 26 of the larger telescoping tube 4 while in use. As illustrated, the smaller telescoping tube 6 may be coupled to the spring 16 by the splicing of second rope 18 to spring loop 22. In this manner, the smaller telescoping tube 6 extends between a retracted position and an extended position in addition to protecting the second rope 18 from chafing.

The spliced loop 12 of the first rope 10 is looped around a piling 28, for quick and easy docking of a boat 34 to a dock 36 or piling 28 (see FIG. 3). The spliced loop 12 of the first rope 10 can be utilized to lasso the piling 28 or dock cleat 38. The second rope 18 is tied to a rear cleat 32 of the boat 34 and may also be tied to a dock cleat 38 with some tension applied by pulling on the second rope 18, while keeping the boat 34 at a safe distance away from the dock 36. The tension on the device will keep the boat 34 away from the dock 36 throughout the tidal range. When properly setup, two spring line assemblies, one on each side of the boat 34, are sufficient to keep the boat 34 docked (see FIG. 3). There is no need for additional ropes when docking in this manner.

If the person utilizing the spring line assembly 2 chooses to tie a loop in the second rope 18 at the correct location, he or she will only need to unhook the tied loop of the second rope 18 at cleat 32 when leaving the dock 36 and rehooking the tied loop of the second rope 18 when returning to the dock 36. This process makes docking simple, safe, and secure without having to worry about retying lines during storm tides or flood tides. When properly setup, the device will compensate for tides, waves, or wakes, keeping the boat 34 away from the dock 36 and/or piling 28. As illustrated, the spring line assembly 2 is completely self-contained and portable.

In the foregoing description, it will be appreciated by those skilled in the art that modifications may be made to the invention without departing from the concepts disclosed herein. Specifically, different sizes and types of pipe may be utilized for the telescoping tubes, and therefore, different sizes and types of bolts, springs, bungee cords and other tensioning devices, lock nuts, and end caps will be a part of the invention without departing from the concepts disclosed herein. In addition, the smaller telescoping tube 6 may be attached directly to the spring loop 22, or may be entirely independent of the spring 16, such that it only protects the second rope 18 from chafing. Such modifications are to be considered as included in the following claims, unless the claims, by their language, expressly state otherwise.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A mooring device comprising:

a first tube having a first end and a second end;

a second tube having a first end and a second end and telescopingly received within the first tube and extendable between a retracted and an extended position;

a first rope having a first end and a second end, wherein the first end is operably coupled to the first tube;

a spring member operably coupled to the first tube and the second tube, wherein the spring member biases the second tube towards the retracted position;

a second rope having a first end and a second end, wherein the second rope is operably coupled to the spring member; and wherein the first end of the second rope extends through a hollow passage within the second tube and is attached to the spring member.

2. The mooring device of claim 1, wherein the first and second tubes comprise polyvinyl chloride (PVC).

3. The mooring device of claim 1, wherein the first end of the first rope is operably coupled to the first tube via a bolt.

4. The mooring device of claim 1, further including:

a first cap member covering the first end of the first tube member.

5. The mooring device of claim 4, wherein the first cap includes an aperture that receives the first rope therethrough.

6. The mooring device of claim 4, further including:

a second cap member covering the second end of the first tube member, wherein the second cap member includes an aperture that receives the second tube therethrough.

7. The mooring device of claim 1, wherein the spring member comprises a coil spring.

8. The mooring device of claim 1, wherein the second end of the first rope comprises a spliced loop.

9. A mooring device comprising:

a first tube having a first end and a second end;

a second tube having a first end and a second end and telescopingly received within the first tube and a longitudinally extending hollow interior space;

a first rope having a first end and a second end, wherein the first end is operably coupled to the first tube;

a second rope having a first end and a second end, wherein the second rope extends through the interior space of the second tube;

a coil spring operably coupled to the first rope and the second rope, wherein the coil spring biases the second rope towards the first rope;

a first cap member covering the first end of the first tube member; and a second cap member covering the second end of the first tube member, wherein the second cap member includes an aperture that receives the second tube therethrough.

10. The mooring device of claim 9, wherein the first and second tubes comprise PVC.

11. The mooring device of claim 9, wherein the first end of the first rope is operably coupled to the first tube via a bolt.

12. The mooring device of claim 9, wherein the second end of the first rope comprises a spliced loop.

* * * * *